US011833774B2

(12) United States Patent
Tanaka et al.

(10) Patent No.: US 11,833,774 B2
(45) Date of Patent: Dec. 5, 2023

(54) DIMENSIONALLY VARIABLE LID MANUFACTURING METHOD AND DIMENSIONALLY VARIABLE LID MANUFACTURING DEVICE

(71) Applicant: RENGO CO., LTD., Osaka (JP)

(72) Inventors: Yoshitsune Tanaka, Tokyo (JP); Hiroyuki Noguchi, Tokyo (JP); Hiroshi Kawado, Saitama (JP); Chiaki Watanabe, Tokyo (JP); Keiichi Fujitani, Osaka (JP); Aya Kinugawa, Osaka (JP); Mikina Soma, Tokyo (JP)

(73) Assignee: RENGO CO., LTD., Osaka (JP)

( * ) Notice: Subject to any disclaimer, the term of this patent is extended or adjusted under 35 U.S.C. 154(b) by 169 days.

(21) Appl. No.: 17/601,181

(22) PCT Filed: Mar. 30, 2020

(86) PCT No.: PCT/JP2020/014577
§ 371 (c)(1),
(2) Date: Oct. 4, 2021

(87) PCT Pub. No.: WO2020/203978
PCT Pub. Date: Oct. 8, 2020

(65) Prior Publication Data

US 2022/0176670 A1 Jun. 9, 2022

(30) Foreign Application Priority Data

Apr. 5, 2019 (JP) ..... 2019-072935

(51) Int. Cl.
*B31B 50/20* (2017.01)
*B31B 50/25* (2017.01)
(Continued)

(52) U.S. Cl.
CPC ..... *B31B 50/20* (2017.08); *B31B 50/25* (2017.08); *B31B 50/88* (2017.08); *B65D 5/548* (2013.01); *B65D 5/64* (2013.01); *B31B 2120/10* (2017.08)

(58) Field of Classification Search
CPC ..... B31B 50/20; B31B 50/25; B31B 50/88; B31B 2120/10; B65D 5/548; B65D 5/64
See application file for complete search history.

(56) References Cited

U.S. PATENT DOCUMENTS 3,812,641 A 5/1974 Bemiss
3,844,201 A * 10/1974 Eggert ..... B31B 50/18 493/362

(Continued)

FOREIGN PATENT DOCUMENTS

CH 372912 10/1963
EP 3 354 581 8/2018

(Continued)

OTHER PUBLICATIONS

English Translation of the International Preliminary Report on Patentability and Written Opinion of the International Searching Authority dated Sep. 28, 2021 in International (PCT) Application No. PCT/JP2020/014577.

(Continued)

*Primary Examiner* — Thomas M Wittenschlaeger
(74) *Attorney, Agent, or Firm* — Wenderoth, Lind & Ponack, L.L.P.

(57) ABSTRACT

A first scoreline, and a perforated line along which a lid can be severed are formed beforehand in a lid sheet. The portion of the lid sheet along its first adjustment side is cut off in a strip shape by a first cutter. The portion of the lid sheet along its second adjustment side is cut off in a strip shape by a second cutter.

8 Claims, 13 Drawing Sheets

(51) Int. Cl.

| | |
|---|---|
| ***B31B 50/88*** | (2017.01) |
| ***B65D 5/54*** | (2006.01) |
| ***B65D 5/64*** | (2006.01) |
| *B31B 120/10* | (2017.01) |

(56) References Cited

U.S. PATENT DOCUMENTS

| | | | | |
|---|---|---|---|---|
| 3,913,300 | A | 10/1975 | Benzing | |
| 3,976,241 | A | 8/1976 | Bemiss | |
| 6,159,137 | A * | 12/2000 | Lee | B31F 1/0025 493/185 |
| 9,821,925 | B2 * | 11/2017 | Yamazaki | B65B 59/02 |
| 9,962,895 | B2 * | 5/2018 | Ponti | B65B 11/004 |
| 9,994,355 | B2 * | 6/2018 | Ishikawa | B65D 5/545 |
| 10,155,352 | B2 * | 12/2018 | Sytema | B31B 50/262 |
| 10,543,945 | B2 * | 1/2020 | Sytema | B65B 5/024 |
| 10,583,943 | B2 * | 3/2020 | Feijen | B65B 5/024 |
| 11,634,244 | B2 * | 4/2023 | Engleman | B65B 51/04 53/531 |
| 2015/0224731 | A1 * | 8/2015 | Ponti | B65D 5/2095 493/59 |
| 2015/0360433 | A1 * | 12/2015 | Feijen | B31B 50/74 493/162 |
| 2017/0001752 | A1 * | 1/2017 | Ishikawa | B65D 5/64 |

FOREIGN PATENT DOCUMENTS

| | | |
|---|---|---|
| FR | 2987824 | 9/2013 |
| JP | 2009-132049 | 6/2009 |
| JP | 2011-230806 | 11/2011 |
| JP | 2015-93698 | 5/2015 |
| JP | 2015-530291 | 10/2015 |
| WO | 02/096755 | 12/2002 |

OTHER PUBLICATIONS

International Search Report dated Jun. 23, 2020 in International (PCT) Application No. PCT/JP2020/014577.

Extended European Search Report dated May 25, 2012 in corresponding European Patent Application No. 20783298.1.

* cited by examiner

DIMENSIONALLY VARIABLE LID MANUFACTURING METHOD AND DIMENSIONALLY VARIABLE LID MANUFACTURING DEVICE

TECHNICAL FIELD

The present invention relates to a dimensionally variable lid manufacturing method and a dimensionally variable lid manufacturing device.

BACKGROUND ART

In recent years, due to rapid expansion of mail-order sales and labor shortage, the product delivery costs are rising.

As a method for reducing the product delivery costs, there is a method by which the sizes of boxes receiving products can be varied (e.g., Japanese Unexamined Patent Application Publication No. 2015-530291). Specifically, when shipping products, they are often shipped in boxes. If the sizes of boxes receiving individual products are variable according to the sizes of the individual products, and such boxes can be manufactured separately for individual products, it is possible to reduce the work space for sorting for shipment and the space for storing products scheduled to be shipped, and also to increase the amount of products that can be loaded into a delivery vehicle at one time. As a result, it is possible to effectively reduce the product delivery costs.

The inventors of the present application considered an automatic packaging line where boxes are manufactured which have sizes corresponding, respectively, to the sizes of individual products different in size from each other, and, while manufacturing them, lids are manufactured from rectangular lid sheets having predetermined sizes such that the lids have sizes corresponding, respectively, to the sizes of the top end openings of the boxes, and the lids are placed on the respective boxes in which the products are received. When manufacturing lids which are to be placed on, and cover, the respective top end openings of boxes, it is necessary to change the sizes of the lids according to the respective sizes of the top end openings of the boxes.

As a method for manufacturing lids of different sizes from rectangular lid sheets having a predetermined size, for example, a method is considered by which lid sheets having a predetermined size are cut to sizes corresponding to the sizes of the top end openings of individual boxes, and a scoreline, a perforated line, etc. are formed at the position of each lid corresponding to the size of the top end opening of the corresponding box. The scoreline formed in the lid is a fold line that allows the lid placed on, and covering, the top end opening of the corresponding box to be bent downwardly along a side of the top end opening of the box. The perforated line formed in the lid comprises a plurality of cuts for guiding the severing of the lid when opening the box.

However, while it is relatively easy to form scorelines and perforated lines at the same positions of many sheets having the same size, it is difficult to stably form scorelines, perforated lines, etc. on the sheets which have been cut to sizes according to the sizes of individual boxes, at positions of the sheets corresponding to the sizes of the top end opening of the respective boxes.

It is an object of the present invention to provide a dimensionally variable lid manufacturing method capable of stably manufacturing lids of different sizes which are, respectively, to be placed on a plurality of boxes having different sizes.

SUMMARY OF THE INVENTION

In order to achieve the above object, the present invention provides a dimensionally variable lid manufacturing method for manufacturing lids which are, respectively, to be placed on a plurality of boxes different in size from each other such that each of the lids has a size corresponding to a size of a top end opening of a corresponding one of the boxes, the method comprising preparing rectangular lid sheets which are to be formed into the respective lids, the rectangular lid sheets being each defined by a first reference side, a second reference side intersecting with the first reference side at a right angle, a first adjustment side extending parallel to the first reference side, and a second adjustment side extending parallel to the second reference side, wherein each of the lid sheets is formed, beforehand, with a first scoreline that allows the lid to be bent downwardly along a first side of the top end opening of the corresponding one of the boxes, and a perforated line along which the lid of the lid sheet can be severed, the first scoreline and the perforated line extending along, and parallel to, the first reference side of the lid sheet; the method further comprising: a first dimension adjustment step of cutting off a portion of each of the lid sheets along the first adjustment side in a strip shape with a first cutter; a second dimension adjustment step of cutting off a portion of the lid sheet along the second adjustment side in a strip shape using a second cutter; and concurrently with the first dimension adjustment step, forming, in the lid sheet, a second scoreline extending parallel to the first scoreline using a scoreline roller disposed at a predetermined interval from the first cutter such that the second scoreline allows the lid to be bent downwardly along a second side of the top end opening of the corresponding one of the boxes, the second side being opposed to the first side; wherein a cut-off width of the portion of the lid sheet cut off by the first cutter, and a cut-off width of the portion of the lid sheet cut off by the second cutter are adjusted according to the size of the top end opening of the corresponding one of the boxes.

With this arrangement, lids can be manufactured by (i) using rectangular lid sheets each formed beforehand with the first scoreline and the perforated line at the portion of the lid sheet along its first reference side; (ii) cutting off, in a strip shape, the portion of each lid sheet along its first adjustment side with the first cutter, and (iii) cutting off, in a strip shape, the portion of the lid sheet along its second adjustment side with the second cutter. At this time, by changing the cut-off widths of the portions of the lid sheets cut off by the first cutter and the cut-off widths of the portions of the lid sheets cut off by the second cutter, according to the sizes of the top end openings of the corresponding boxes, it is possible to change the sizes of the lids. In other words, since the sheets are used without cutting off their portions along the first reference sides regardless of the sizes of the lids, it is possible to form beforehand the first scorelines and the perforated lines in the lid sheets. Since, as described above, it is possible to use lid sheets equal in size to each other, and each formed beforehand with the first scoreline and the perforated line at the same positions as the first scorelines and the perforated lines of the other lid sheets, it is possible to stably manufacture lids of different sizes.

Each of the above lid sheets may include: an L-shaped dimension adjustment area along the first adjustment side and the second adjustment side of the lid sheet; and a rectangular reference area surrounded by the L-shaped dimension adjustment area, the first reference side, and the second reference side of the lid sheet, with an independent object printed beforehand on the reference area.

With this arrangement, the rectangular reference area surrounded by the L-shaped dimension adjustment area, the first reference side, and the second reference side always remains in each lid sheet without being cut off, regardless of the size of the lid. Therefore, by printing beforehand an independent object (such as a cargo-handling instruction mark or a brand logo mark) within the reference area of the lid sheet, even when changing the size of the lid, it is possible to keep the printed independent object on the lid without being partially cut off.

It is preferable that, from a plurality of lid sheet magazines each keeping a group of the lid sheets that are different in size from the lid sheets in the other lid sheet magazines, the lid sheets having sizes corresponding to the sizes of the top end openings of the corresponding ones of the boxes are selectively taken out, one at a time, and used.

By doing so, it is possible to reduce the cut-off widths of the portions of the lid sheets cut off by the first cutter and the cut-off widths of the portions of the lid sheets cut off by the second cutter, and therefore, the material cost of the lid sheets. Also, in an arrangement in which the lid sheets each includes an L-shaped dimension adjustment area along the first adjustment side and the second adjustment side, and a rectangular reference area surrounded by the L-shaped dimension adjustment area, the first reference side, and the second reference side, and in which independent objects are printed beforehand within the reference areas of the respective lid sheets, it is possible to change the size of the object on the reference area of each lid sheet, by changing the size of the reference area according to the size of the lid sheet.

In addition to the above manufacturing method, the present invention also provides the below-described dimensionally variable lid manufacturing device, which can stably manufacture lids of different sizes which are, respectively, to be placed on a plurality of boxes different in size from each other.

Specifically, the present invention provides a dimensionally variable lid manufacturing device for manufacturing lids which are, respectively, to be placed on a plurality of individual boxes different in size from each other such that each of the lids has a size corresponding to a size of a top end opening of a corresponding one of the individual boxes, wherein as a material for each of the lids, a rectangular lid sheet is used which is defined by a first reference side, a second reference side intersecting with the first reference side at a right angle, a first adjustment side extending parallel to the first reference side, and a second adjustment side extending parallel to the second reference side, wherein the lid sheet is formed, beforehand, with a first scoreline that allows the lid to be bent downwardly along a first side of the top end opening of the corresponding one of the boxes, and a perforated line along which the lid can be severed, the first scoreline and the perforated line extending along, and parallel to, the first reference side of the lid sheet; the dimensionally variable lid manufacturing device comprising: a first cutter configured to cut off, in a strip shape, a portion of the lid sheet along the first adjustment side thereof; a second cutter configured to cut off, in a strip shape, a portion of the lid sheet along the second adjustment side thereof; a scoreline roller disposed at a predetermined interval from the first cutter such that, when the portion of the lid sheet along the first adjustment side thereof is cut off in a strip shape by the first cutter, the scoreline roller forms, in the lid sheet, a second scoreline that extends parallel to the first scoreline of the lid sheet and allows the lid to be bent downwardly along a second side of the top end opening of the corresponding one of the boxes, the second side being opposed to the first side, and a cut-off-width adjusting mechanism configured to adjust a cut-off width of the portion of the lid sheet cut off by the first cutter, and a cut-off width of the portion of the lid sheet cut off by the second cutter, according to the size of the top end opening of the corresponding one of the boxes.

With this arrangement, since it is possible to use lid sheets of the same size each formed beforehand with the first scoreline and the perforated line at the same positions as the first scorelines and the perforated lines of the other lid sheets, it is possible to stably manufacture lids of different sizes.

The above lid manufacturing device is preferably a device further comprising a lid sheet conveying device configured to convey the lid sheets in a direction parallel to the first reference sides of the lid sheets, wherein the first cutter is disposed at a position which the lid sheets pass so as to cut, in a conveying direction in which the lid sheets are conveyed by the lid sheet conveying device, the lid sheets while being conveyed by the lid sheet conveying device, wherein the scoreline roller is disposed at a position which the lid sheets pass so as to press the lid sheets while being conveyed by the lid sheet conveying device, thereby forming the second scorelines in the respective lid sheets, and wherein the dimensionally variable lid manufacturing device further comprises a second cutter moving device supporting the second cutter, and configured to move the second cutter, while stopping conveyance of each of the lid sheets, in a direction orthogonal to the conveying direction such that the second cutter cuts the lid sheet in a direction orthogonal to the first reference side of the lid sheet.

With this arrangement, the cutting off by the first cutter and the second scoreline formation by the scoreline roller can be efficiently carried out while lid sheets are being conveyed by the lid sheet conveying device. Also, since the cutting off by the second cutter is carried out while stopping the conveyance of lid sheets, it is not necessary to change the direction in which the lid sheets are conveyed by the lid sheet conveying device, to the orthogonal direction. Therefore, the lid sheet conveying device has a simple structure.

The above lid sheet conveying device preferably includes: a lid sheet clamper configured to clamp the lid sheets from above and below; and a lid sheet clamper moving device configured to move the lid sheet clamper in a horizontal direction parallel to the first reference side of each of the lid sheets.

With this arrangement, since it is possible to stabilize the posture of each lid sheet while being conveyed by the lid sheet conveying device, it is possible to accurately carry out the cutting off by the first cutter and the second scoreline formation by the scoreline roller.

EFFECTS OF THE INVENTION

For the dimensionally variable lid manufacturing method of the present invention, lids can be manufactured by (i) using rectangular lid sheets each formed beforehand with the first scoreline and the perforated line at the area of the lid sheet along its first reference side; (ii) cutting off, in a strip shape, the portion of each lid sheet along its first adjustment side with the first cutter, and (iii) cutting off, in a strip shape, the portion of the lid sheet along its second adjustment side with the second cutter. At this time, by changing the cut-off widths of the portions of the lid sheets cut off by the first cutter and the cut-off widths of the portions of the lid sheets cut off by the second cutter, according to the sizes of the top end openings of the corresponding boxes, it is possible to change the sizes of the lids. In other words, since each lid sheet is used without cutting off the portion of the lid sheet along its first reference side regardless of the size of the lid, it is possible to form beforehand the first scoreline and the perforated line in the lid sheet. Since, as described above, it is possible to use lid sheets equal in size to each other, and each formed beforehand with the first scoreline and the perforated line at the same position as the other lid sheets, it is possible to stably manufacture lids of different sizes.

DETAILED DESCRIPTION OF THE INVENTION

Figure 1:
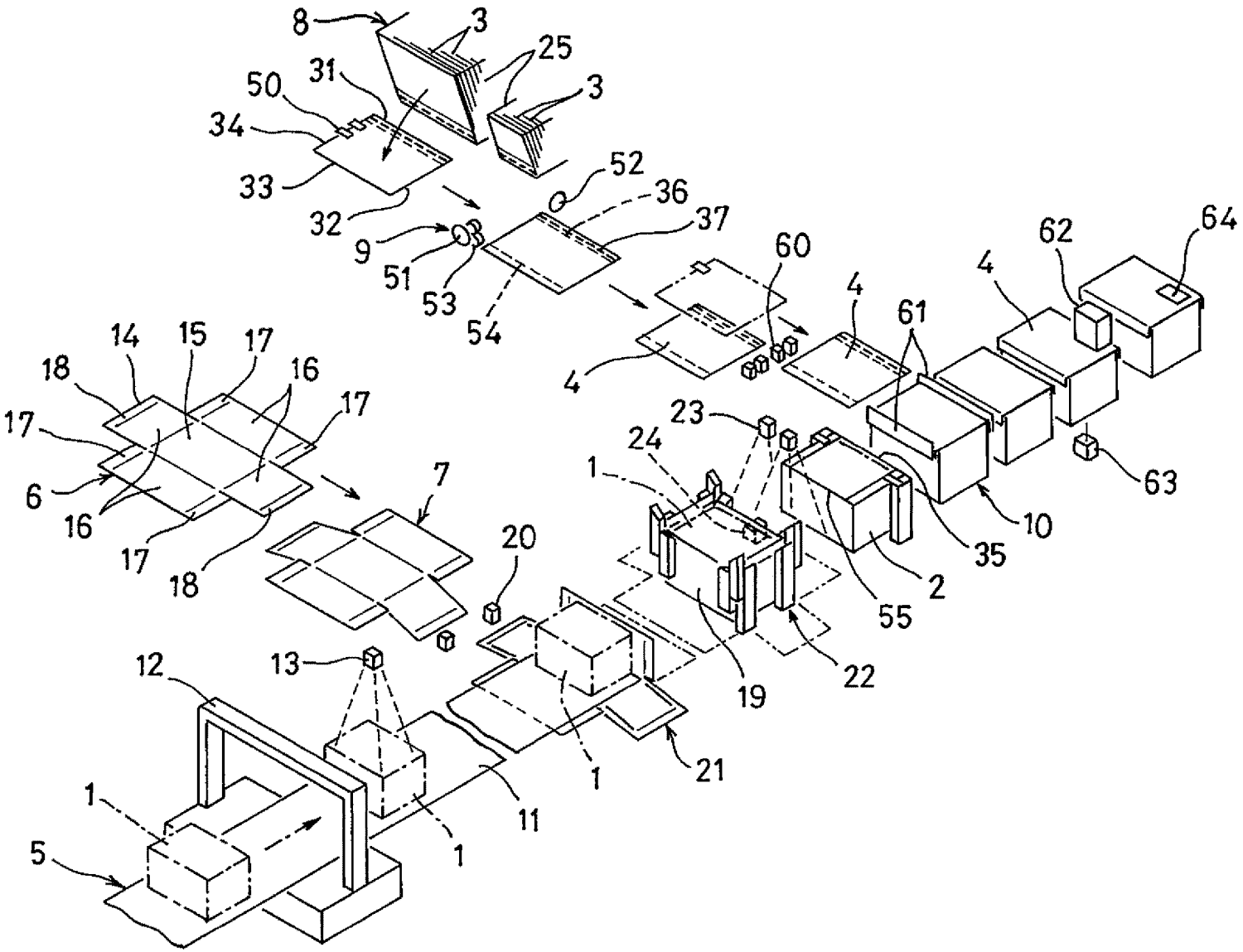
FIG. 1 is a perspective view schematically illustrating an automatic packaging line including the step of manufacturing lids by a dimensionally variable lid manufacturing method embodying the present invention.

The dimensionally variable lid manufacturing method embodying the present invention is now described with reference to the automatic packaging line shown in FIG. 1. In this automatic packaging line, corrugated paperboard boxes 2 are manufactured which have sizes corresponding, respectively, to the sizes of individual products 1 different in size from each other, and, simultaneously, from rectangular lid sheets 3 having predetermined sizes, lids 4 having sizes corresponding, respectively, to the sizes of the rectangular top end openings of the corrugated paperboard boxes 2 are manufactured, and the lids 4 are placed on the respective corrugated paperboard boxes 2, with the products 1 received therein. This automatic packaging line includes a product supply station 5, a box blank manufacturing device 6, a box erecting station 7, a lid sheet supply station 8, a lid manufacturing device 9, and a lid placing station 10.

The product supply station 5 includes a conveyor 11 that conveys the products 1; a product size measuring device 12 that measures the sizes of the products 1; and a product code reader 13 that reads product identification codes attached to the respective products 1. The product size measuring device 12 is a gate sensor installed to an intermediate portion of the conveyor 11, and configured to measure the width, depth, and height dimensions of the products 1 while being conveyed by the conveyor 11. The product size information measured by the product size measuring device 12 and the product identification code information read by the product code reader 13 are transmitted to a management control device (not shown). The product identification code attached to each product 1 is a one-dimensional code (bar code) or a two-dimensional code (such as QR code or DataMatrix code). The product code reader 13 comprises an image sensor (CMOS area sensor, CCD area sensor) that takes pictures of the product identification codes; and a built-in processing part that reads the product identification code information from the image data obtained by the image sensor. In the product supply station 5, each product 1, with the product identification code attached, is supplied by the conveyor 11 to the box erecting station 7, located downstream of the product supply station 5.

Based on the product size information of each product 1 read by the product size measuring device 12, the box blank manufacturing device 6 manufactures a box blank 14 of a corrugated paperboard box 2 having a size corresponding to the size of the product 1. The box blank 14 includes a rectangular bottom panel 15 and four side panels 16 integrally connected, respectively, to the four sides of the bottom panel 15 via scorelines.

One pair of the four side panels 16 that are opposed to each other across the bottom panel 15 have joint flaps 17 integrally connected to both sides thereof. The joint flaps 17 are to be glued to the other pair of side panels 16, respectively. A flap 18 is integrally connected to the top end of each of the other pair of side panels 16.

The box blank 14 is formed of corrugated paperboard. The corrugated paperboard is either (i) double-sided corrugated paperboard, in which front and back linerboards are bonded to both sides of a corrugated medium, or (ii) composite double-sided corrugated paperboard, in which a second corrugated medium and a second back linerboard are bonded to the back linerboard of double-sided corrugated paperboard. A product identification code (not shown) having information corresponding to the product identification code read by the product code reader 13 is printed on the bottom surface of the bottom panel 15 of the box blank 14.

The type of the product identification code printed on the bottom panel 15 of the box blank 14 (bar code, QR code, DataMatrix code, etc.) does not necessarily need to coincide with the type of the corresponding product identification code attached to the product 1 (bar code, QR code, DataMatrix code, etc.). For example, if the product identification code attached to the product 1 is a QR code, a DataMatrix code, which is a two-dimensional code different in type from a QR code, may be printed on the bottom panel 15 of the box blank 14. In this case, a DataMatrix code having information corresponding to the QR code attached to the product 1 is printed on the bottom panel 15.

The box erecting station 7 includes a glue applying device 20 that applies glue to each box blank 14 manufactured by the box blank manufacturing device 6; a product transferring section 21 that transfers the product 1 onto the bottom panel 15 of the box blank 14; and a case forming device 22 that forms a corrugated paperboard box 2 by bending the side panels 16 of the box blank 14, with the product 1 placed thereon, at right angles relative to the bottom panel 15.

The case forming device 22 erects each box blank 14 with the product 1 placed on the bottom panel 15 of the box blank 14, to form a corrugated paperboard box 2 in which the product 1 is received, and of which the top end is open so that the product identification code attached to the product 1 is exposed upwardly. When the box blank 14 is erected by the case forming device 22, the four side panels 16 of the erected blank box 14 form a quadrangular and tubular trunk portion 19. The thus-erected corrugated paperboard box 2 is a body box in which the bottom end of the trunk portion 19 is closed by the bottom panel 15, and the top end of the trunk portion 19 is open in a rectangular shape. That is, the top edges of the four side panels 16 define the four sides of the rectangular shape of the top end opening of the corrugated paperboard box 2. The size of the top end opening of the corrugated paperboard box 2 is equal to the size of the bottom panel 15, and the height dimension of the corrugated paperboard box 2 is equal to the height dimension of each side panel 16.

The case forming device 22 includes a product-side code reader 23 and a box-side code reader 24. The product-side code reader 23 is installed at a position opposed to the top side of the corrugated paperboard box 2 so as to read the product identification code attached to the product 1 in the corrugated paperboard box 2, before a lid 4 is placed on the box in the lid placing station 10. The box-side code reader 24 is installed at a position opposed to the underside of the bottom panel 15 of the corrugated paperboard box 2 so as to read the product identification code attached to the bottom panel 15 of the corrugated paperboard box 2, before the lid 4 is placed on the box in the lid placing station 10. The product-side code reader 23 and the box-side code reader 24 are electrically connected to a matching inspection device (not shown). The matching inspection device inspects whether or not the product 1 in the corrugated paperboard box 2 correctly corresponds to the corrugated paperboard box 2 receiving the product 1, by comparing and checking the product identification code read by the product-side code reader 23 and the product identification code read by the box-side code reader 24.

From a plurality of lid sheet magazines 25 each keeping, in a stacked state, a group of lid sheets different in lid sheet size from the sheets in the other magazines 25, the lid sheet supply station 8 selectively takes out, one at a time, the lid sheets 3 each having a size corresponding to the size of the top end opening of the corresponding corrugated paperboard box 2 receiving a product 1, based on the product size information read by the product size measuring device 12, and the lid sheet supply station 8 supplies the lid sheets 3 to the lid manufacturing device 9. The lid manufacturing device 9 processes the lid sheets 3 to manufacture lids 4 which are to be placed on respective corrugated paperboard boxes 2, which are different in size from each other, such that the lids 4 have sizes corresponding, respectively, to the sizes of the top end openings of the individual corrugated paperboard boxes 2.

Figure 2:
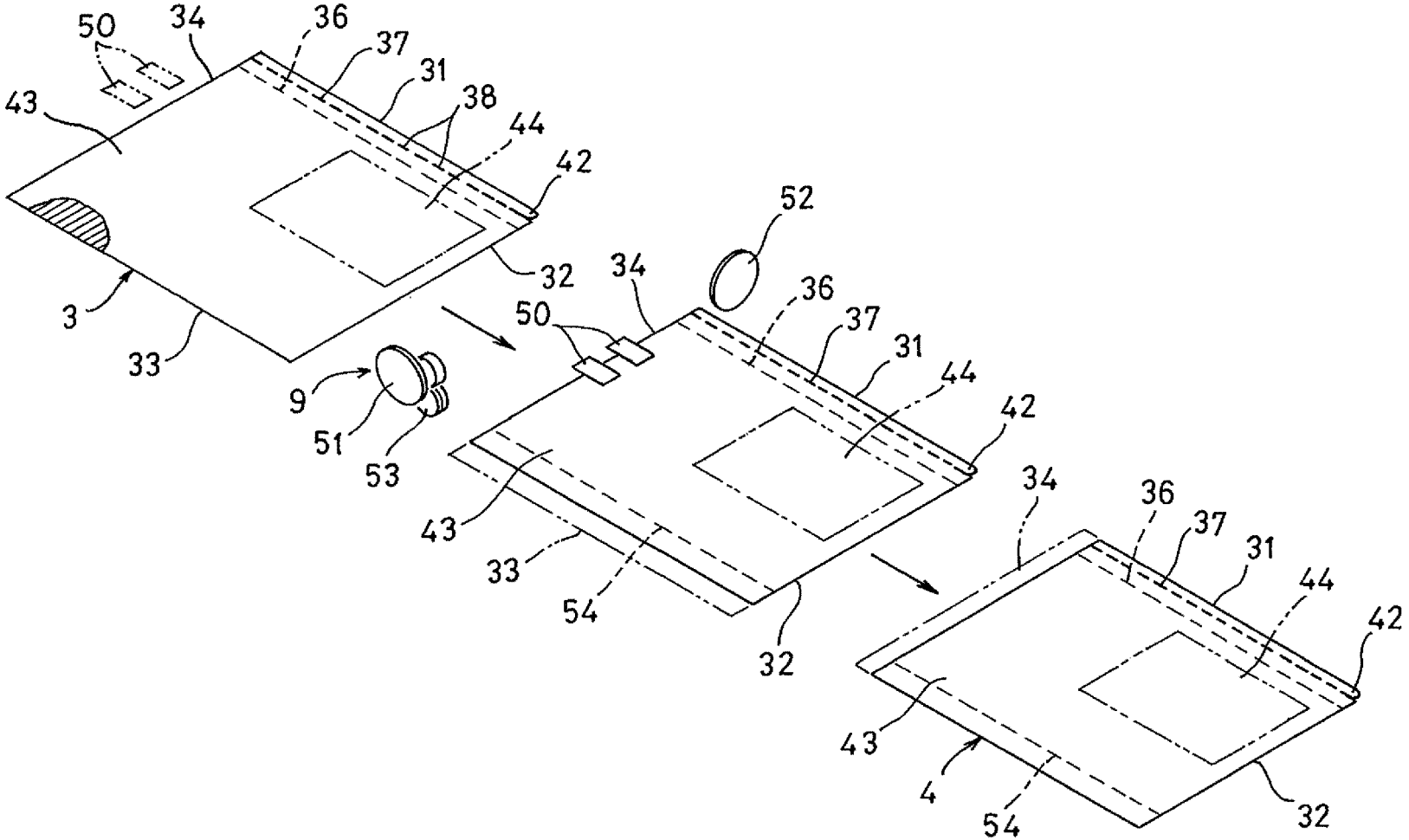
FIG. 2 is a perspective view schematically illustrating the step of manufacturing lids by a lid manufacturing device of the automatic packaging line of FIG. 1.
Figure 3:
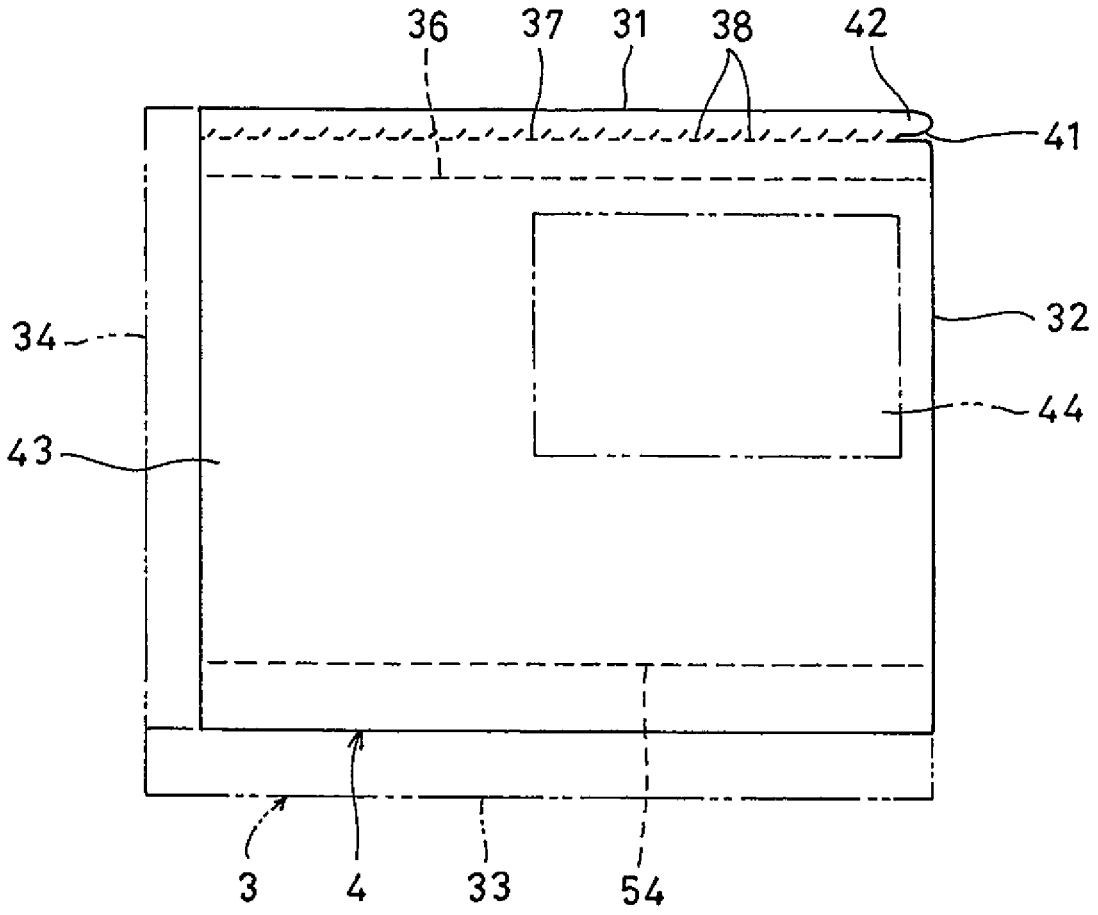
FIG. 3 is a plan view of a lid of FIG. 2.

As illustrated in FIGS. 2 and 3, each lid sheet 3, which is to be formed into a lid 4, is a rectangular sheet defined by a first reference side 31, a second reference side 32 intersecting with the first reference side 31 at a right angle, a first adjustment side 33 extending parallel to the first reference side 31, and a second adjustment side 34 extending parallel to the second reference side 32. In this embodiment, the lid sheet 3 is formed of corrugated paperboard. The corrugated paperboard is either (i) double-sided corrugated paperboard, in which front and back linerboards are bonded to both sides of a corrugated medium, or (ii) composite double-sided corrugated paperboard, in which a second corrugated medium and a second back linerboard are bonded to the back linerboard of double-sided corrugated paperboard. The first reference side 31 and the first adjustment side 33 extend perpendicularly to the flutes of the corrugated paperboard. The second reference side 32 and the second adjustment side 34 extend parallel to the flutes of the corrugated paperboard.

The lid sheet 3 includes a first scoreline 36 that allows the lid 4 to be bent downwardly along a first side 35 (see FIG. 1) of the top end opening of the corresponding corrugated paperboard box 2; and a perforated line 37 along which the lid 4 can be severed, the first scoreline 36 and the perforated line 37 being formed beforehand to extend along, and parallel to, the first reference side 31. The first scoreline 36 is a fold line formed by linearly recessing the undersurface of the lid sheet 3. The perforated line 37 is composed of a plurality of cuts which guide the severing of the lid 4 when opening the corrugated paperboard box 2. The perforated line 37 is located between the first scoreline 36 and the first reference side 31.

Figure 4:
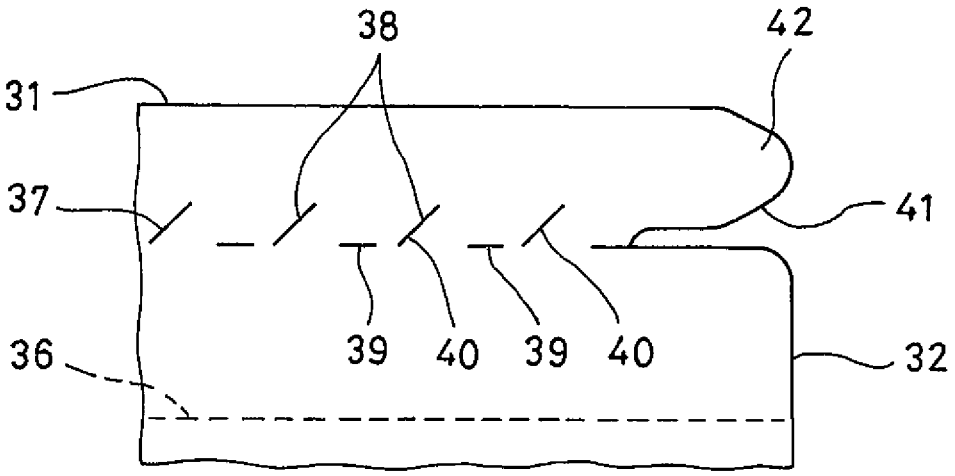
FIG. 4 is an enlarged view of the portion of the lid of FIG. 3 where first and second reference sides of the lid intersect with each other.

As illustrated in FIG. 4, the plurality of cuts 38 constituting the perforated line 37 are arranged in the direction parallel to the first reference side 31. Each cut 38 is composed of a straight portion 39 extending parallel to the first reference side 31; and an inclined portion 40 inclined toward the first reference side 31 from the imaginary straight line passing through all the straight portions 39. Each inclined portion 40 is inclined to gradually approach the above imaginary straight line from its end closer to the severing start side (right side in FIG. 4) of the perforated line 37 toward its end closer to the severing end side (left side in FIG. 4) of the perforated line 37. Both of the inclined portion 40 and the straight portion 39 extend through the lid sheet 3 in its thickness direction. While the inclined portion 40 is separated from the straight portion 39 in the shown example, the inclined portion 40 and the straight portion 39 may be connected to each other. At the position of the second reference side 32 of the lid sheet 3 where the perforated line 37 intersects, the lid sheet 3 has a recessed edge 41 recessed from the second reference side 32 toward the perforated line 37, to define a tab 42 for starting to sever the perforated line 37 between this recessed edge 41 and the first reference side 31.

As illustrated in FIGS. 2 and 3, the lid sheet 3 includes an L-shaped dimension adjustment area 43 along the first adjustment side 33 and the second adjustment side 34; and a rectangular reference area 44 surrounded by the L-shaped dimension adjustment area 43, the first reference side 31, and the second reference side 32. An independent object (not shown) is printed beforehand within the reference area 44. The "independent object" is not an object, such as a continuous pattern, that causes no problem even if it is partially cut off, but an object that makes no sense if it is partially cut off, for example, a cargo-handling instruction mark (mark stipulated in JIS standard 20150 or ISO standard 780, for example, a "this side up" mark, or a "keep dry" mark), a brand logo mark, written delivery instructions, or written instructions on how to open the corrugated paperboard box 2.

As illustrated in FIG. 2, the lid manufacturing device 9 includes a lid sheet conveying device 50 that conveys each lid sheet 3 in the direction parallel to the first reference side 31; a first cutter 51 that cuts the lid sheet 3 in the conveying direction while the lid sheet is being conveyed by the lid sheet conveying device 50, to cut off, in a strip shape, an area of the lid sheet 3 along the first adjustment side 33; a scoreline roller 53 that presses the lid sheet 3 while the lid sheet is being conveyed by the lid sheet conveying device 50, to form a second scoreline 54 extending in the conveying direction; and a second cutter 52 that cuts the lid sheet 3 in the direction orthogonal to the first reference side 31 while temporarily stopping the conveyance of the lid sheet 3, thereby cutting off, in a strip shape, the area of the lid sheet 3 along the second adjustment side 34.

The lid sheet conveying device 50 is configured to convey the lid sheets 3 using the first reference side 31 of each lid sheet 3 as a reference. Specifically, when conveying the lid sheets 3, which are different in size, and selectively supplied from the lid sheet magazines 25, the lid sheet conveying device 50 conveys them such that, regardless of the sizes of these lid sheets 31, their first reference sides 31 are all located at the same position.

The first cutter 51 and the scoreline roller 53 are each disposed at a position where each lid sheet 3 passes while the lid sheet 3 is being conveyed by the lid sheet conveying device 50. The scoreline roller 53 forms the second scoreline 54 when the first cutter 51 cuts off, in a strip shape, the area of the lid sheet 3 along the first adjustment side 33. The second scoreline 54 extends parallel to the first scoreline 36. As illustrate in FIG. 1, the second scoreline 54 is a fold line formed by linearly recessing the undersurface of the lid sheet 3 such that the lid 4 can be bent downwardly along a second side 55 (side opposed to the first side 35) of the top end opening of the corresponding corrugated paperboard box 2.

As illustrated in FIG. 2, the first cutter 51 and the scoreline roller 53 are disposed at (spaced apart) a predetermined interval in the direction orthogonal to the conveying direction of the lid sheet 3. The distance between the first cutter 51 and the scoreline roller 53 is set to correspond to the distance between the first reference side 31 and the first scoreline 36 of the lid sheet 3. The second cutter 52 is supported to be moved, by a second cutter moving device 56 (see FIG. 5), in the direction orthogonal to the direction in which the lid sheet 3 is conveyed by the lid sheet conveying device 50.

The cut-off width of the portion of the lid sheet 3 cut off by the first cutter 51 and the cut-off width of the portion of the lid sheet 3 cut off by the second cutter 52 can be changed, by the below-described cut-off-width adjusting mechanism 57 (see FIG. 5), according to the size of the top end opening of the corresponding corrugated paperboard box 2.

As illustrated in FIG. 1, the lid placing station 10 includes a glue applying device 60 that applies glue to each lid 4 processed and fed by the lid manufacturing device 9; and a lid pressure-bonding device 61 by which the lid 4, to which glue has been applied by the glue applying device 60, is placed on, covers, and is pressure-bonded to, the top end opening of the corresponding corrugated paperboard box 2 receiving a product 1. Thus, in the lid placing station 10, the top end opening of the corresponding corrugated paperboard box 2 obtained in the box erecting station 7 is closed by the lid 4 placed on, to cover, the top end opening of the corrugated paperboard box 2.

A labeler 62 and a code reader 63 for the labeler are installed downstream of the lid placing station 10. The labeler 62 is arranged at a position opposed to the top side of the lid 4 of the corrugated paperboard box 2 so as to bond, to the lid 4 placed on the corrugated paperboard box 2, a delivery slip 64 corresponding to the product 1 in the corrugated paperboard box 2. The deliver slip 64 is bonded to a portion of the reference area 44 (see FIGS. 2 and 3) of the lid 4 where no independent object (such as a cargo-handling instruction mark) is printed.

The code reader 63 for the labeler is installed at a position opposed to the underside of the bottom panel 15 of the corrugated paperboard box 2 so as to read the product identification code attached to the bottom panel 15 of the corrugated paperboard box 2, before a delivery slip 64 is bonded by the labeler 62. The code reader 63 is electrically connected to a second matching inspection device (not shown). The matching inspection device compares and checks the product identification code read by the code reader 63 and the information of a delivery slip 64 which is to be bonded by the labeler 62, and decides whether or not the corrugated paperboard box 2 correctly corresponds to the delivery slip 64.

Figure 5:
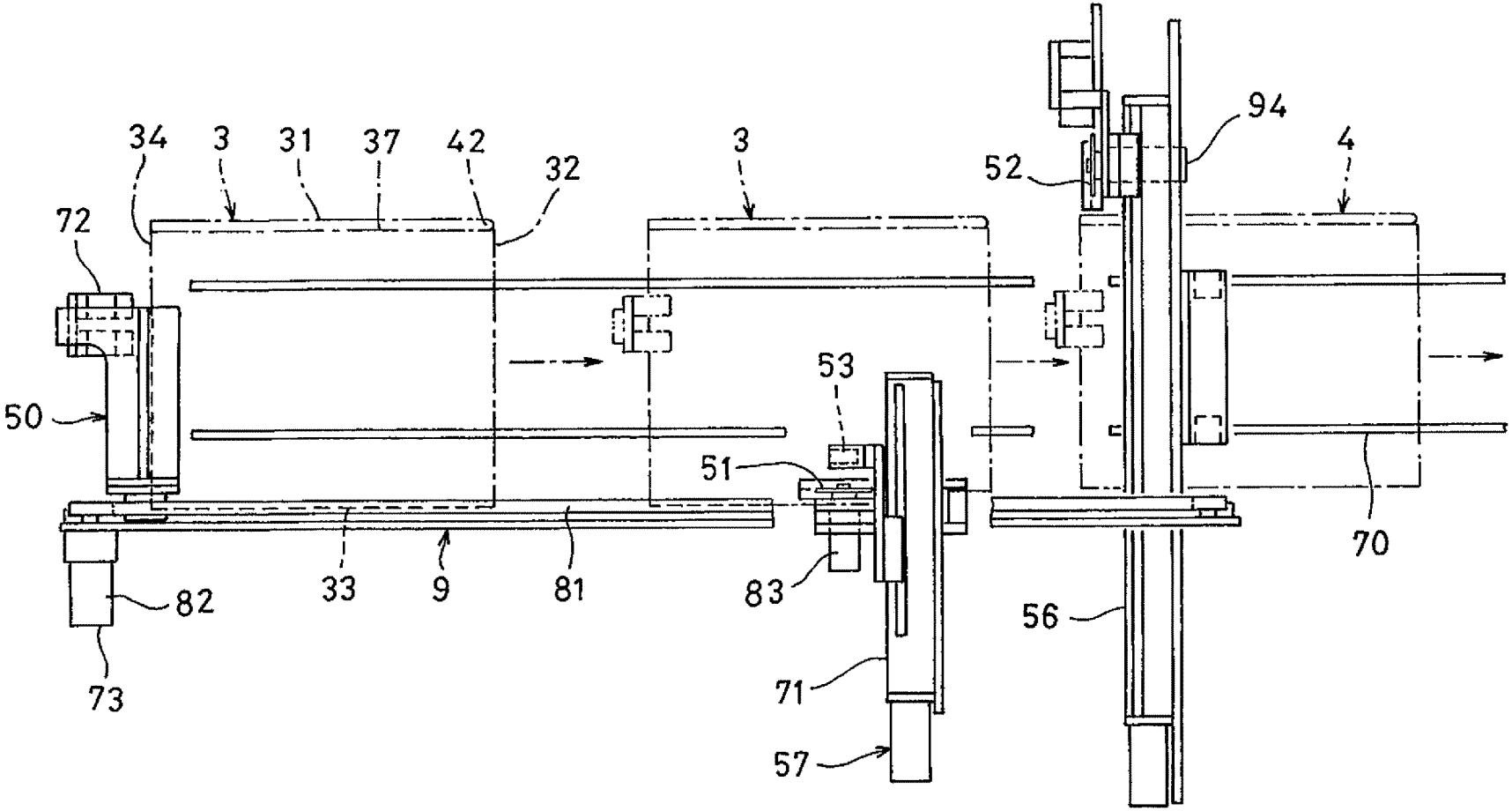
FIG. 5 is a plan view of the lid manufacturing device of the automatic packaging line of FIG. 1.

FIG. 5 shows the lid manufacturing device 9. The lid manufacturing device 9 includes the lid sheet conveying device 50, which conveys each lid sheet 3 straight in a horizontal direction, and a lid conveying device 70 disposed downstream of the lid sheet conveying device 50. The lid conveying device 70 is disposed downstream of and adjacent to the lid sheet conveying device 50 so as to receive the lid sheet 3 from the lid sheet conveying device 50, and convey it in the same direction as it is conveyed by the lid sheet conveying device 50.

The cut-off-width adjusting mechanism 57, which is configured to change the cut-off width of the portion of the lid sheet 3 cut off by the first cutter 51 and the cut-off width of the portion of the lid sheet 3 cut off by the second cutter 52, is constituted by a first cutter position adjusting device 71 which can freely change, in the direction orthogonal to the conveying direction of the lid sheet 3, the position of the first cutter 51 when cutting the lid sheet 3; and the lid sheet conveying device 50, which can freely change the conveyance stopping position of the lid sheet 3 (position of the lid sheet 3 when cut by the second cutter 52).

Figure 6:
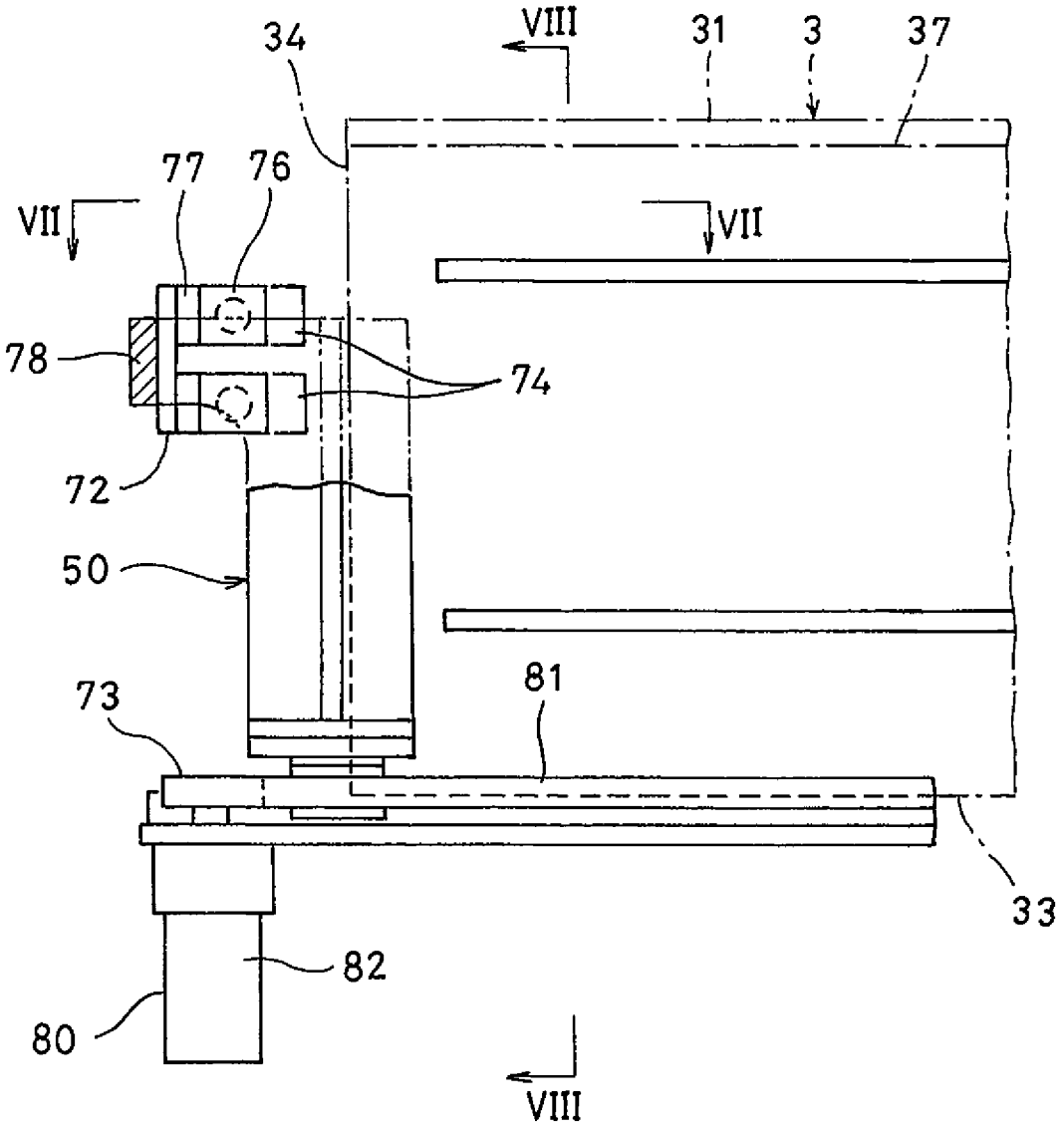
FIG. 6 is an enlarged view illustrating a lid sheet clamper of the lid manufacturing device of FIG. 5, and the vicinity thereof.
Figure 7:
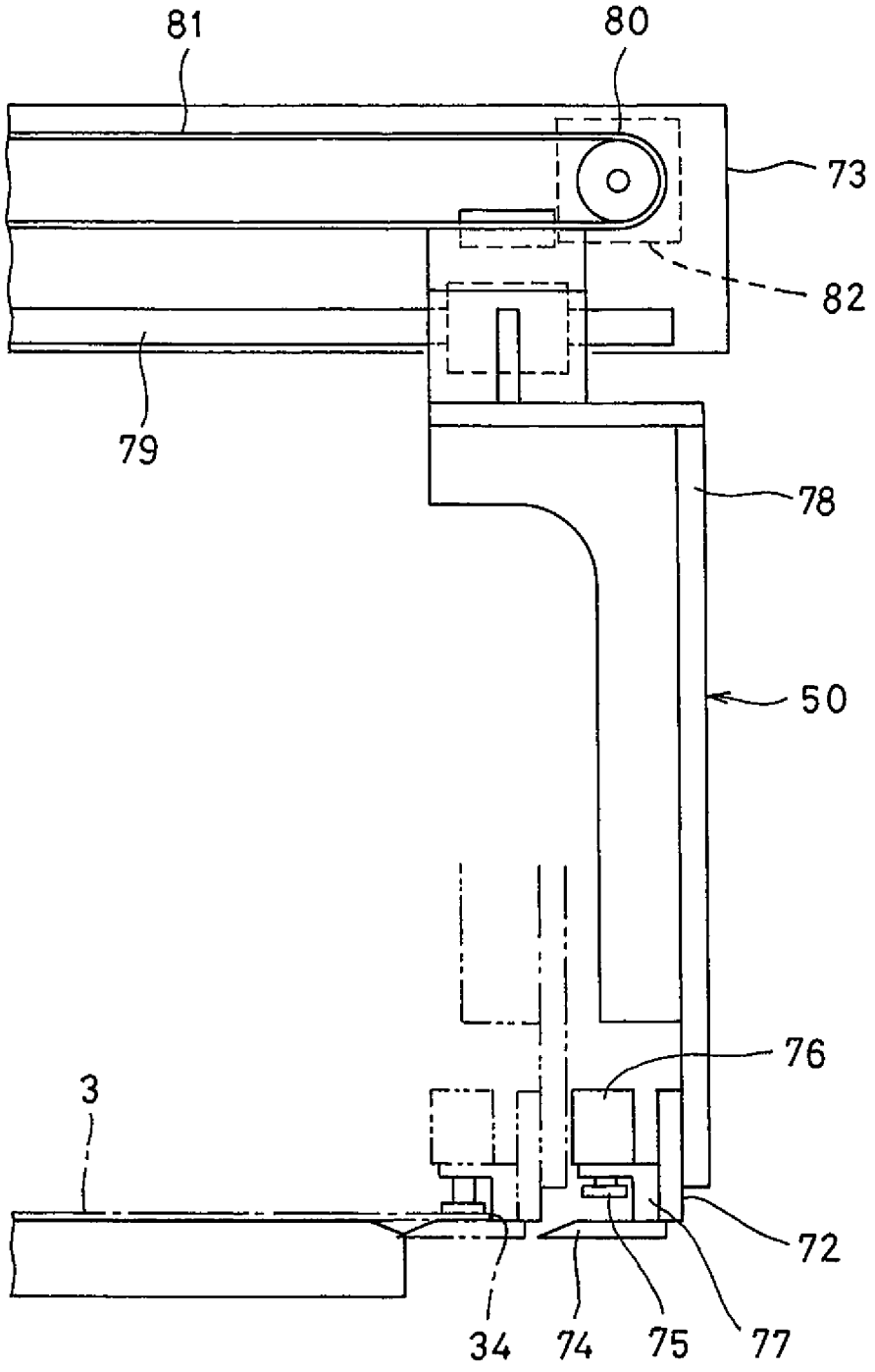
FIG. 7 is a sectional view taken along line VII-VII of FIG. 6.
Figure 8:
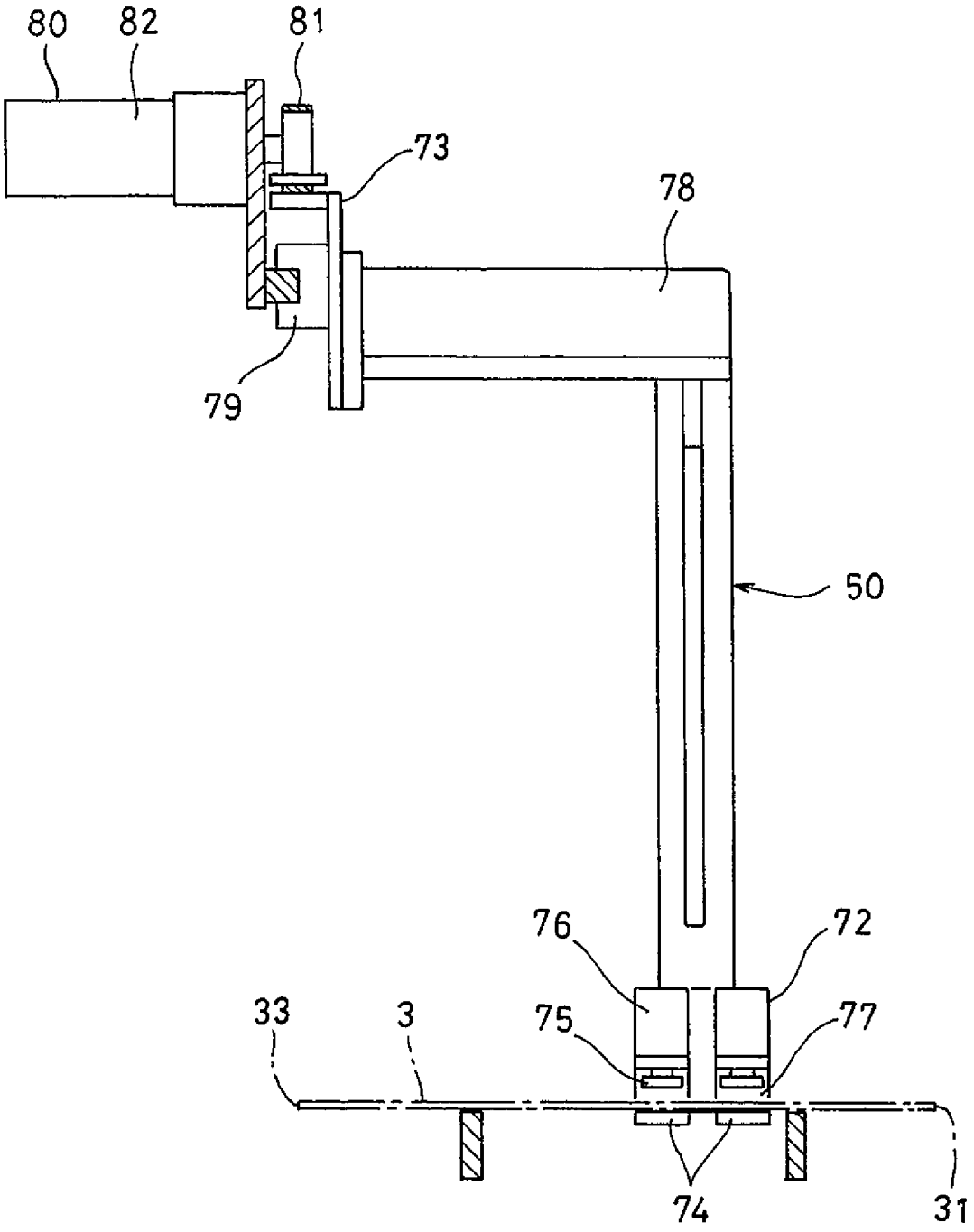
FIG. 8 is a sectional view taken along line VIII-VIII of FIG. 6.

As illustrated in FIGS. 6 to 8, the lid sheet conveying device 50 includes a lid sheet clamper 72 that clamps the lid sheet 3 from above and below; and a lid sheet clamper moving device 73 that moves the lid sheet clamper 72 in the direction parallel to the first reference side 31 of the lid sheet 3. The lid sheet clamper 72 clamps a rear end portion of the lid sheet 3 in the conveying direction (i.e., an area of the lid sheet 3 along the second adjustment side 34).

As illustrated in FIG. 7, the lid sheet clamper 72 includes lower clamping members 74 that support the rear end portion of the lid sheet 3 from the lower side; upper clamping members 75 disposed above the lower clamping members 74 so as to be opposed to the lower clamping members 74; and a clamping actuator 76 that vertically moves the upper clamping members 75. The clamping actuator 76 is, e.g., an air cylinder activated by air pressure. Rising walls 77 are fixed to the lower clamping members 74 so as to be opposed, in the sheet conveying direction, to the rear end portion of the lid sheet 3. The rising walls 77 support the lid sheet 3 from the rear side in the conveying direction, thereby preventing the lid sheet 3 from being displaced in the conveying direction due to the resistance during processing of the lid sheet 3.

As illustrated in FIG. 8, the lid sheet clamper moving device 73 includes a lid sheet clamper bracket 78 that supports the lid sheet clamper 72 (which forms a single unit composed of the lower clamping members 74, the upper clamping members 75 and the clamping actuator 76); a lid sheet conveyance linear guide 79 that supports the lid sheet clamper bracket 78 such that the lid sheet clamper bracket 78 is movable in the conveying direction in the lid sheet conveying device 50; and a lid sheet conveyance actuator 80 that moves the lid sheet clamper bracket 78 in the conveying direction in the lid sheet conveying device 50. The lid sheet conveyance actuator 80 comprises an annular belt 81 connected to the lid sheet clamper bracket 78; and an electric motor 82 that drives the belt 81. The lid sheet conveying device 50 controls the amount by which the electric motor 82 rotates, thereby making it possible to freely change the conveyance stopping position of the lid sheet 3.

Figure 9:
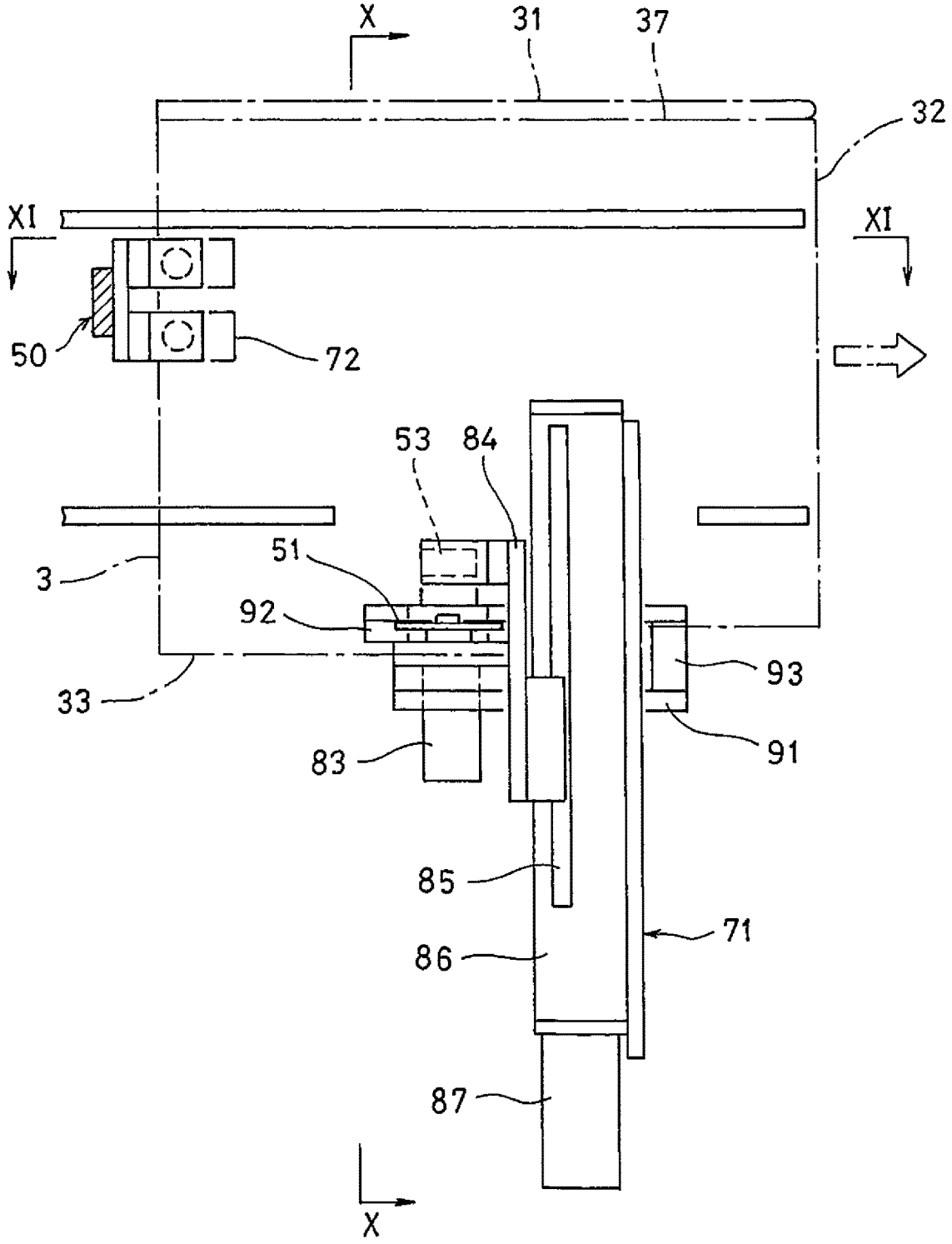
FIG. 9 is an enlarged view illustrating a first cutter of the lid manufacturing device of FIG. 5, and the vicinity thereof.
Figure 10:
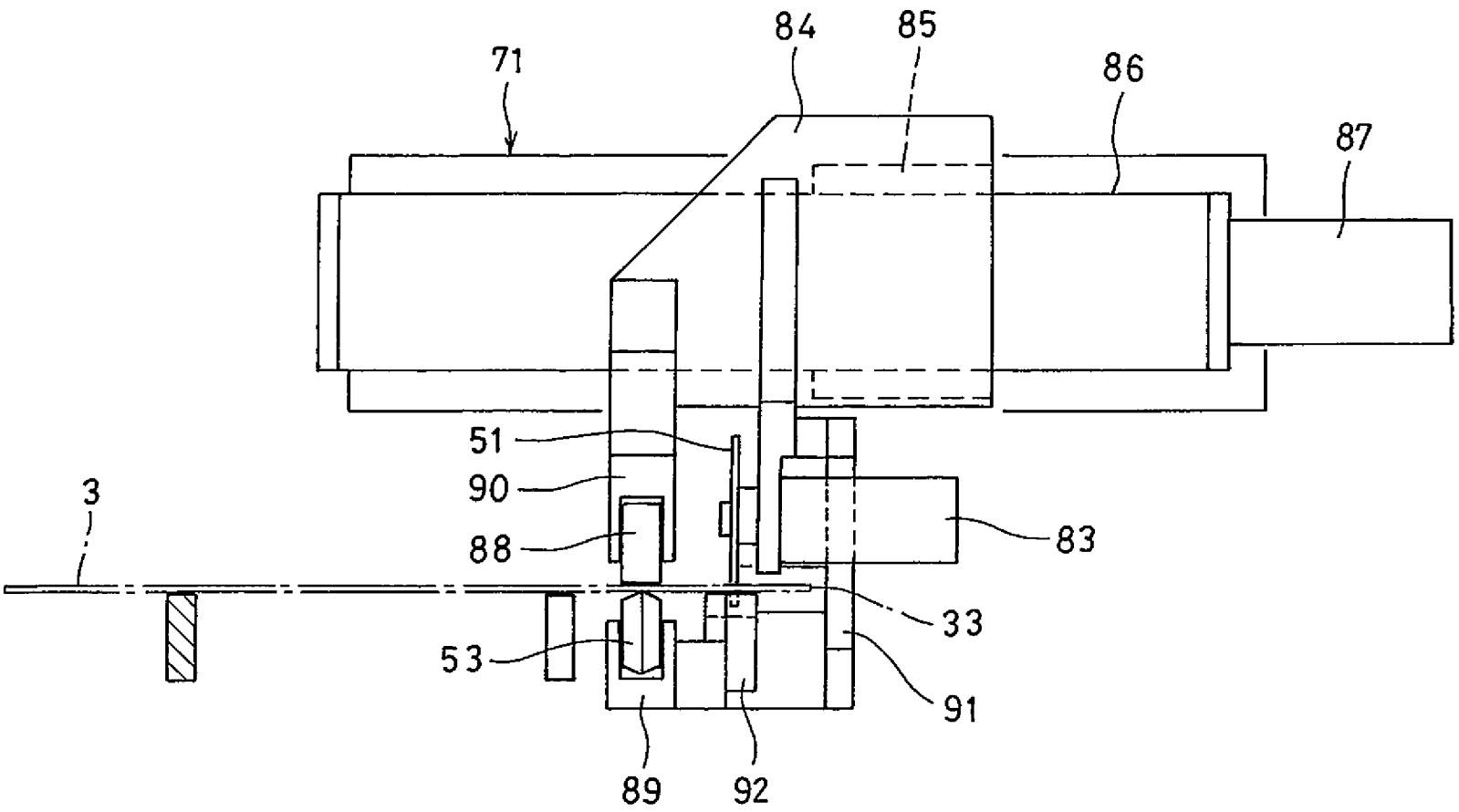
FIG. 10 is a sectional view taken along line X-X of FIG. 9.

As illustrated in FIGS. 9 and 10, an electric motor 83 is mounted to the first cutter 51 so as to rotationally drive the first cutter 51. The electric motor 83 is a geared motor with a built-in speed reducer. The first cutter 51 is a round rotary blade (see FIG. 11) that rotates about a center axis extending in the horizontal direction orthogonal to the direction in which the lid sheet 3 is conveyed by the lid sheet conveying device 50. The first cutter 51 and the electric motor 83 are supported by the first cutter position adjusting device 71.

The first cutter position adjusting device 71 moves the first cutter 51 in the direction orthogonal to the direction in which the lid sheet 3 is conveyed by the lid sheet conveying device 50, thereby changing the cut-off width of the portion of the lid sheet 3 cut off by the first cutter 51. The first cutter position adjusting device 71 includes a first cutter linear guide 85 that supports a first cutter bracket 84 supporting the first cutter 51 and the electric motor 83 such that the first cutter bracket 84 is movable in the horizontal direction orthogonal to the direction in which the lid sheet 3 is conveyed by the lid sheet conveying device 50; and a first cutter position adjustment actuator 86 that moves the first cutter bracket 84 along the first cutter liner guide 85. The first cutter position adjustment actuator 86 is a feed screw mechanism driven by an electric motor 87.

As illustrated in FIG. 10, the scoreline roller 53 and a receiving roller 88 are mounted to the first cutter bracket 84. The scoreline roller 53 is disposed under the lid sheet 3 so as to press the underside of the lid sheet 3. The receiving roller 88 is disposed above the scoreline roller 53 so as to be opposed to the scoreline roller 53 such that the lid sheet 3 is sandwiched from above and below by the receiving roller 88 and the scoreline roller 53. The first cutter bracket 84 includes a scoreline roller supporting portion 89 that rotatably supports the scoreline roller 53; a receiving roller supporting portion 90 that rotatably supports the receiving roller 88; and a coupling portion 91 that couples the scoreline roller supporting portion 89 and the receiving roller supporting portion 90 to each other. The coupling portion 91 is arranged so as to horizontally oppose the first adjustment side 33 of the lid sheet 3. A first cutter receiver 92 is disposed under the first cutter 51, and fixed to the scoreline roller supporting portion 89 of the first cutter bracket 84.

Figure 11:
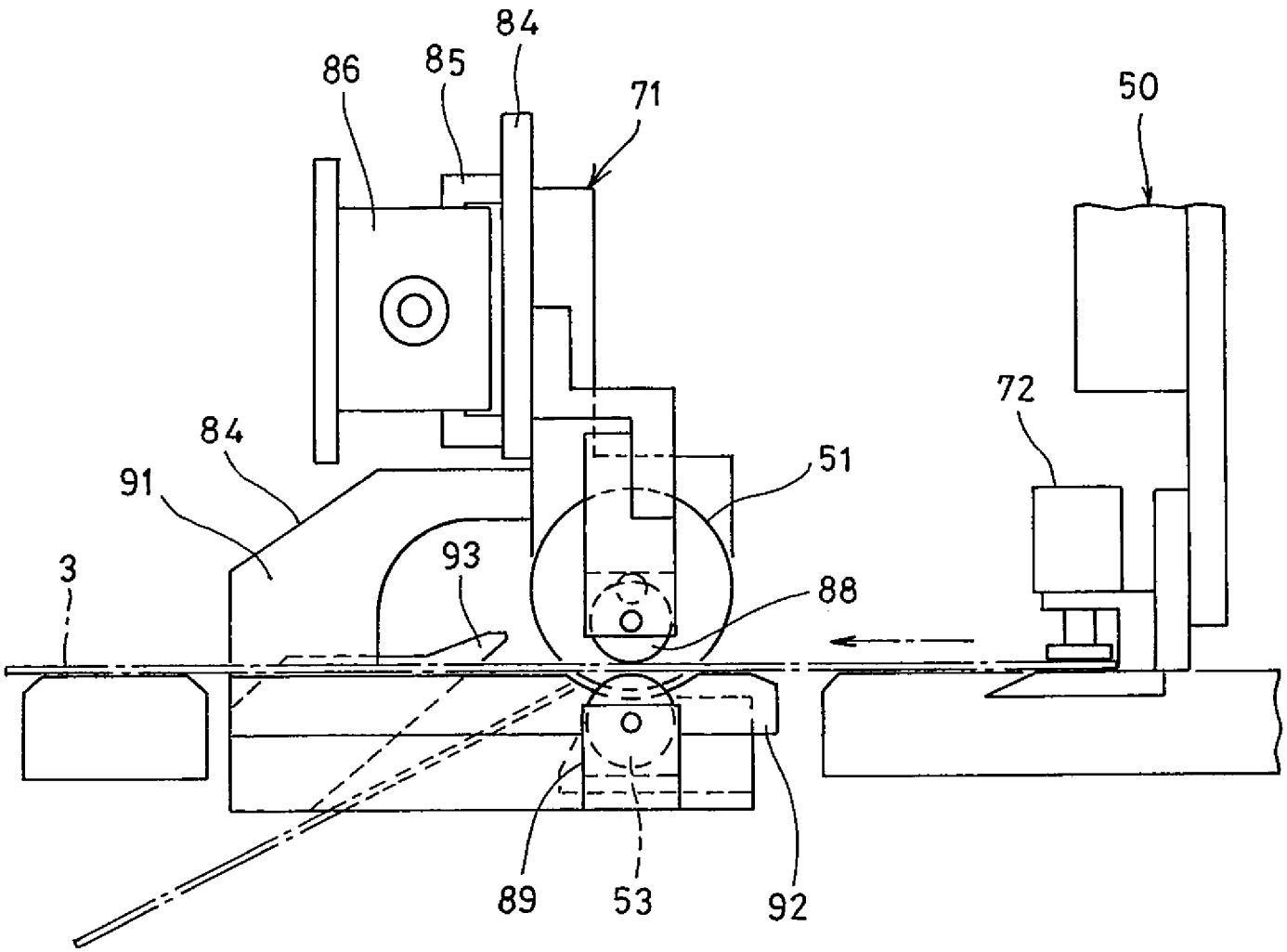
FIG. 11 is a sectional view taken along line XI-XI of FIG. 9.

As illustrated in FIG. 11, the first cutter bracket 84 is provided with a first cut-off-portion guide 93 by which the strip-shaped portion of the lid sheet 3 cut off by the first cutter 51 is guided downwardly on the downstream side of the first cutter 51.

Figure 12:
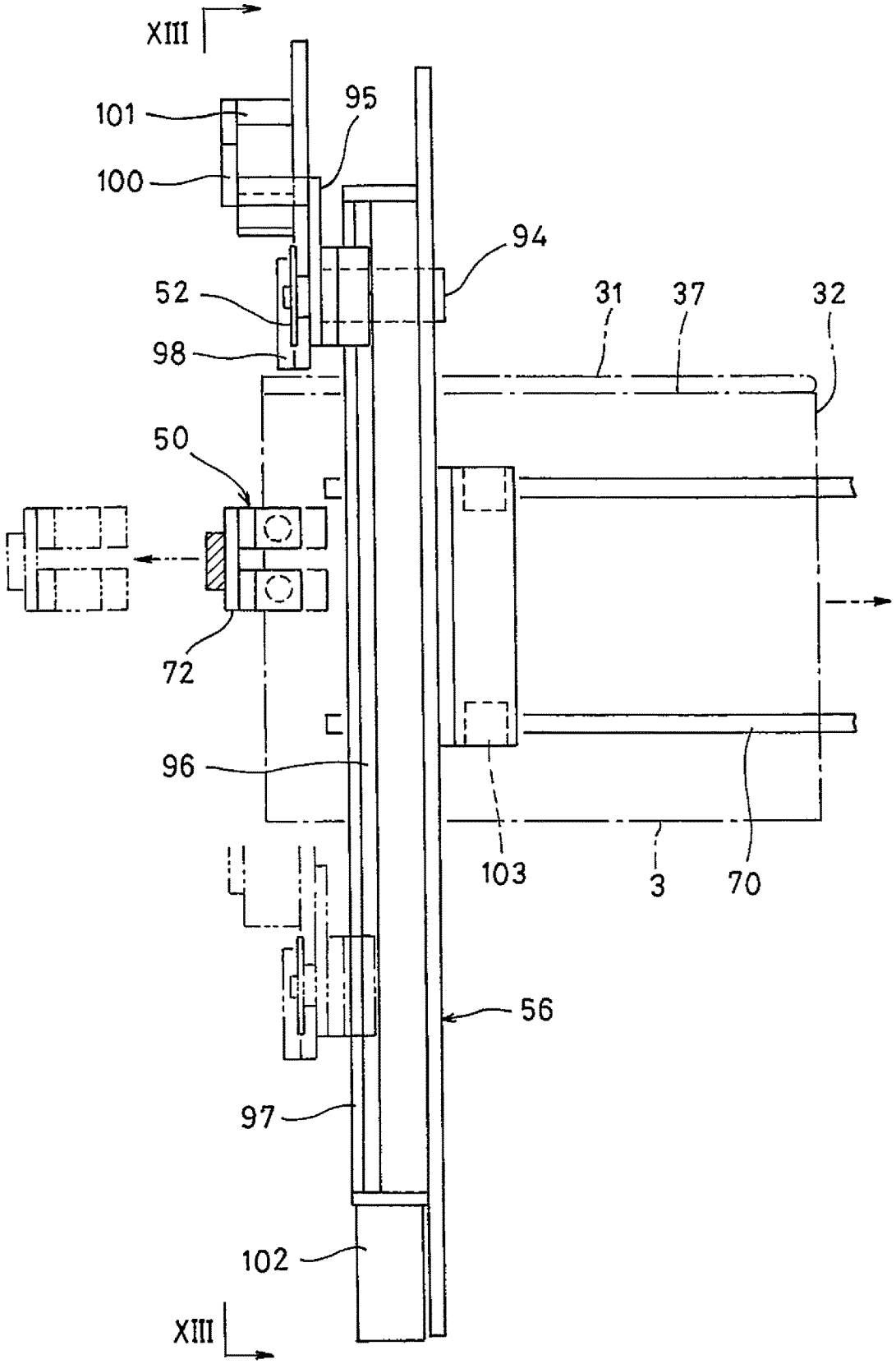
FIG. 12 is an enlarged view illustrating a second cutter and a second cutter moving device of the lid manufacturing device of FIG. 5, and the vicinities thereof.

As illustrated in FIG. 12, an electric motor 94 is mounted to the second cutter 52 so as to rotationally drive the second cutter 52. The electric motor 94 is a geared motor with a built-in speed reducer. The second cutter 52 is a round rotary blade (see FIG. 13) that rotates about a center axis extending in the horizontal direction parallel to the direction in which the lid sheet 3 is conveyed by the lid sheet conveying device 50. The second cutter 52 and the electric motor 94 are supported by the second cutter moving device 56, which moves the second cutter 52 in the horizontal direction orthogonal to the direction in which the lid sheet 3 is conveyed by the lid sheet conveying device 50. Downstream of the moving range of the second cutter 52, a holding clamping device 103 is disposed which can hold the lid sheet 3 by sandwiching the lid sheet 3 from above and below.

Figure 13:
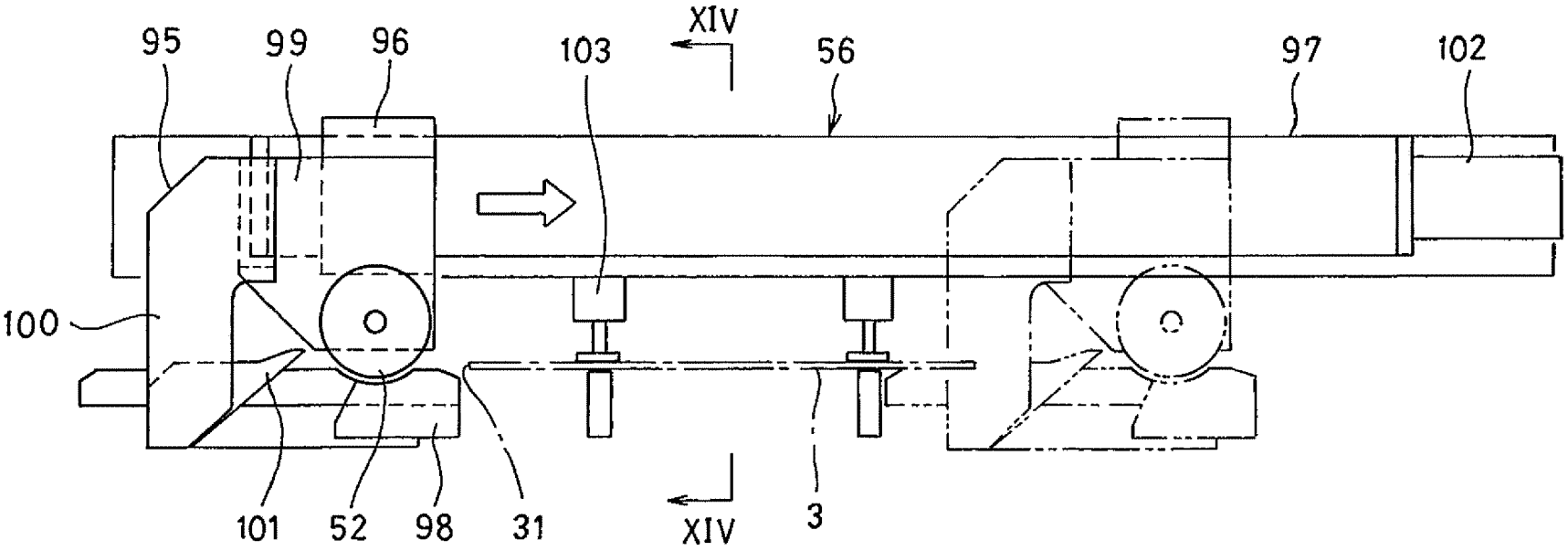
FIG. 13 is a sectional view taken along line XIII-XIII of FIG. 12.

As illustrated in FIGS. 12 and 13, the second cutter moving device 56 includes a second cutter linear guide 96 that supports a second cutter bracket 95 supporting the second cutter 52 and the electric motor 94 (see FIG. 12) such that the second cutter bracket 95 is movable in the horizontal direction orthogonal to the direction in which the lid sheet 3 is conveyed by the lid sheet conveying device 50; and a second cutter moving actuator 97 that moves the second cutter bracket 95 along the second cutter liner guide 96. The second cutter moving actuator 97 is a feed screw mechanism driven by an electric motor 102.

As illustrated in FIG. 13, a second cutter receiver 98 is disposed under the second cutter 52. The second cutter bracket 95 includes a cutter supporting portion 99 that supports the second cutter 52 and the electric motor 94 (see FIG. 12); and a coupling portion 100 that couples the cutter supporting portion 99 and the second cutter receiver 98 to each other.

Figure 14:
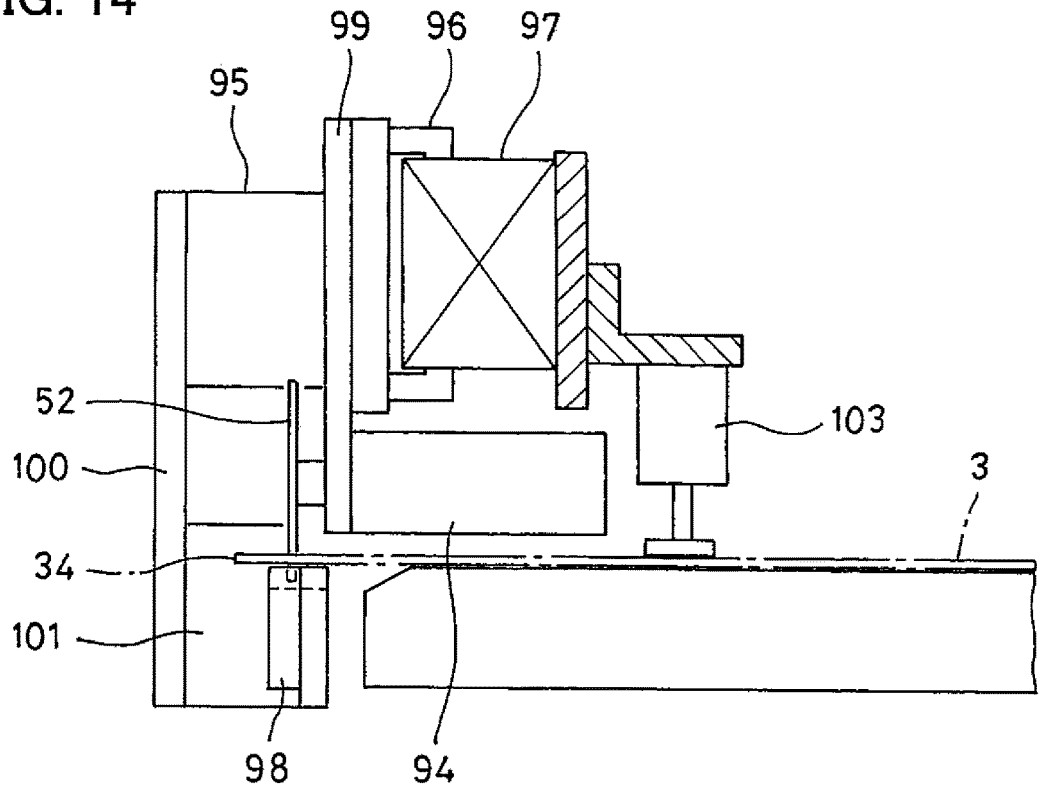
FIG. 14 is a sectional view taken along line XIV-XIV of FIG. 13.

As illustrated in FIG. 14, the coupling portion 100 is disposed to move through a position horizontally opposed to the second adjustment side 34 of the lid sheet 3, when the second cutter 52 cuts off, in a strip shape, the portion of the lid sheet 3 along the second adjustment side 34. In the embodiment, the holding clamping device 103 is an air cylinder disposed above the lid sheet 3 so as to be opposed to the lid sheet 3, and capable of switching between holding of the lid sheet 3 and releasing of its holding by moving the rod of the air cylinder up and down.

Figure 15:
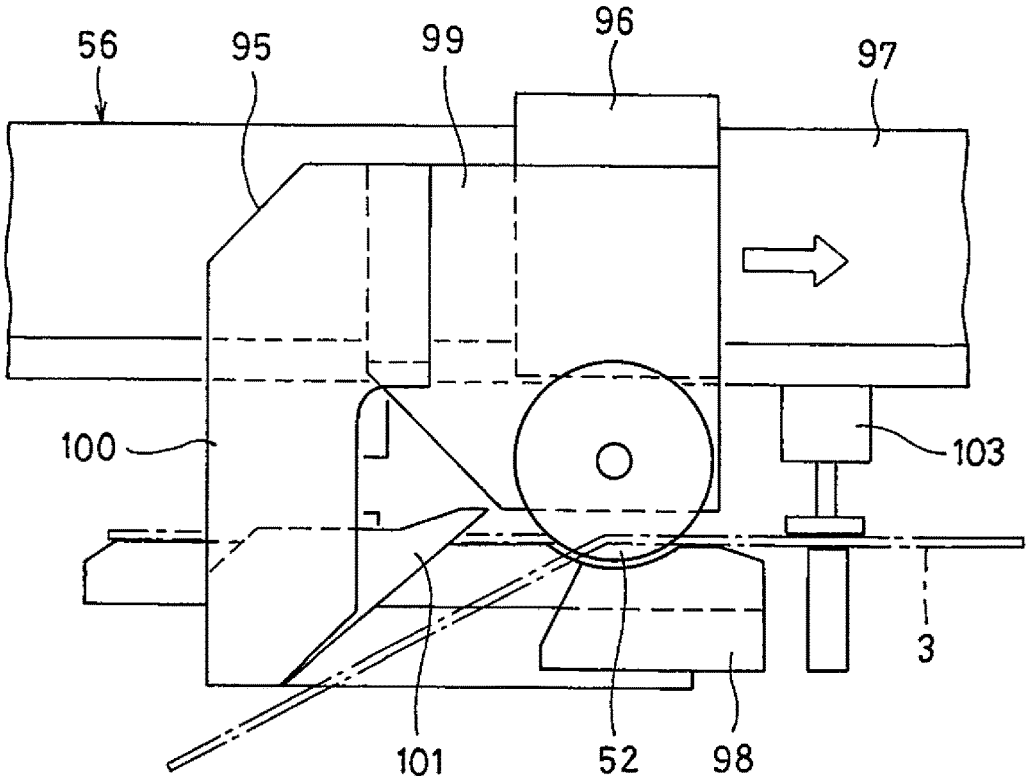
FIG. 15 is an enlarged view of the second cutter of FIG. 13 and the vicinity thereof, the enlarged view illustrating the state in which a lid sheet is being cut by the second cutter.

As illustrated in FIGS. 13 and 15, the second cutter bracket 95 is provided with a second cut-off-portion guide 101 by which the strip-shaped portion of the lid sheet 3 cut off by the second cutter 52 when the second cutter 52 moves from the first reference side 31 toward the first adjustment side 33 (from the left side toward the right side in FIGS. 13 and 15) is guided downwardly on the downstream side of the second cutter 52.

By using this lid manufacturing device 9, it is possible, for example, to perform cutting and scoreline formation on lid sheets 3 supplied from the lid sheet supply station 8 (see FIG. 1) as described below, and to manufacture lids 4 having sizes corresponding, respectively, to the sizes of the top end openings of individual corrugated paperboard boxes 2.

The lid sheet conveying device 50 conveys in a straight line each rectangular lid sheet 3 including the pre-formed first scoreline 36 and perforated line 37 at the area of the lid sheet along the first reference side 31 as illustrated in FIG. 2, and while the lid sheet 3 is being conveyed, a first dimension adjustment step is performed to cut off a portion of the lid sheet 3 along the first adjustment side 33 in a strip shape with the first cutter 51. Concurrently with this first dimension adjustment step, the second scoreline 54 is formed in the surface of the lid sheet 3 (while being conveyed) on the underside thereof with the scoreline roller 53, which is disposed at a predetermined interval from the first cutter 51 toward the first reference side 31.

Next, the conveyance of the lid sheet 3 by the lid sheet conveying device 50 is stopped. Then, with the conveyance of the lid sheet 3 stopped, a second dimension adjustment step is performed in which, by moving the second cutter 52 in the direction orthogonal to the direction in which the lid sheet 3 is conveyed by the lid sheet conveying device 50, the portion of the lid sheet 3 along the second adjustment side 34 is cut off in a strip shape by the second cutter 52. At this time, by activating the holding clamping device 103, the holding clamping device 103 holds the lid sheet 3 while sandwiching the lid sheet 3 from above and below, thereby preventing displacement of the lid sheet 3 due to the resistance caused when the second cutter 52 cuts the lid sheet 3.

By changing the cut-off widths of the portions of the lid sheet 3 cut off by the first cutter 51 in the first dimension adjustment step and the cut-off widths of the portions of the lid sheets 3 cut off by the second cutter 52 in the second dimension adjustment step, according to the size of the top end openings of the corresponding corrugated paperboard boxes 2, it is possible to change the sizes of the lids 4. Specifically, when the lid sheet 3 are cut by the first cutter 51, by changing beforehand the position of the first cuter 51 in the direction orthogonal to the conveying direction of the lid sheet 3 by the first cutter position adjusting device 71 (see FIG. 5), it is possible to change the cut-off widths of the portions of the lid sheets 3 cut off by the first cutter 51 in the first dimension adjustment step. Also, by changing the conveyance stopping positions of the lid sheets 3 (positions of the lid sheets 3 when cut by the second cutter 52) by the lid sheet conveying device 50, it is possible to change the cut-off widths of the portions of the lid sheets 3 cut off by the second cutter 52 in the second dimension adjustment step.

Since, as described above, according to the lid manufacturing method of this embodiment, as illustrated in FIG. 3, the lid sheets 3 are used without cutting off the portions of the lid sheets 3 along the first reference sides 31 regardless of the sizes of the lids 4, it is possible to form beforehand the first scoreline 36 and the perforated line 37 in each lid sheet 3. Therefore, it is possible to use lid sheets 3 equal in size to each other, and each formed beforehand with the first scoreline 36 and the perforated line 37 at the same positions as the first scorelines 36 and the perforated lines 37 of the other lid sheets, and thus to stably manufacture lids 4 of different sizes.

Also, according to the lid manufacturing method of this embodiment, the rectangular reference area 44, which is surrounded by the L-shaped dimension adjustment area 43, the first reference side 31, and the second reference side 32, always remains in each lid sheet 3 without being cut off, regardless of the size of the lid 4. Therefore, by printing beforehand an independent object (such as a cargo-handling instruction mark or a brand logo mark) within the reference area 44 of the lid sheet 3, even when changing the size of the lid 4, it is possible to keep the independent object printed on the lid 4 without being partially cut off.

Also, according to the lid manufacturing method of this embodiment, since, lid sheets 3 each having a size corresponding to the size of the top end opening of the corresponding corrugated paperboard box 2 are selectively taken out and used from a plurality of lid sheet magazines 25 each keeping a group of lid sheets having a different lid sheet size from the lid sheets in the other magazines, it is possible to reduce the cut-off width of the portion of each lid sheet 3 cut off by the first cutter 51 and the cut-off width of the portion of the lid sheet 3 cut off by the second cutter 52. Therefore, it is possible to reduce the cost of the material forming the lid sheets 3. Also, by making the reference areas 44 of the lid sheets 3 of each lid sheet group differ in size from the reference areas 44 of the lid sheets 3 of any of the other lid sheet groups, it is possible to print, within the reference area 44, an object having a size corresponding to the size of each lid 4.

In the lid manufacturing device 9 of this embodiment, because the cutting off by the first cutter 51 and the scoreline formation by the scoreline roller 53 are carried out while the lid sheets 3 are being conveyed by the lid sheet conveying device 50, these steps can be carried out efficiently. Also, since the cutting off by the second cutter 52 is carried out while stopping the conveyance of the lid sheets 3, it is not necessary to change the direction in which the lid sheets 3 are conveyed by the lid sheet conveying device 50, to the orthogonal direction. Therefore, the lid sheet conveying device 50 has a simple structure.

Also, since, in the lid manufacturing device 9 of this embodiment, a lid sheet conveying device 50 is used which is constituted by a lid sheet clamper 72 that clamps each lid sheet 3 from above and below; and a lid sheet clamper moving device 73 that moves the lid sheet clamper 72 in the horizontal direction parallel to the first reference side 31, it is possible to stabilize the posture of the lid sheet 3 while being conveyed by the lid sheet conveying device 50. Therefore, it is possible to accurately carry out the cutting off by the first cutter 51 and the scoreline formation by the scoreline roller 53.

The above-described embodiment is a mere example in every respect, and the present invention is not limited thereto. Therefore, the scope of the present invention is indicated not by the above description but by the claims, and should be understood to include all modifications within the scope and meaning equivalent to the scope of the claims.

DESCRIPTION OF REFERENCE NUMERALS

2: Corrugated paperboard box
3: Lid sheet
4: Lid
25: Lid sheet magazine
31: First reference side
32: Second reference side
33: First adjustment side
34: Second adjustment side
35: First side
36: First scoreline
37: Perforated line
43: Dimension adjustment area
44: Reference area
50: Lid sheet conveying device
51: First cutter
52: Second cutter
53: Scoreline roller
54: Second scoreline
55: Second side
56: Second cutter moving device
57: Cut-off-width adjusting mechanism
72: Lid sheet clamper
73: Lid sheet clamper moving device

The invention claimed is:

1. A dimensionally variable lid manufacturing method for manufacturing lids which are, respectively, to be placed on a plurality of boxes different in size from each other such that each of the lids has a size corresponding to a size of a top end opening of a corresponding one of the boxes, the method comprising:

preparing rectangular lid sheets which are to be formed into the respective lids, each of the rectangular lid sheets being defined by a first reference side, a second reference side intersecting with the first reference side at a right angle, a first adjustment side extending parallel to the first reference side, and a second adjustment side extending parallel to the second reference side, forming each of the lid sheets, beforehand with a first scoreline that allows the lid to be bent downwardly along a first side of the top end opening of the corresponding one of the boxes, and a perforated line along which the lid of the lid sheet can be severed, the first scoreline and the perforated line extending along, and parallel to, the first reference side of the lid sheet;

cutting off a portion of each of the lid sheets along the first adjustment side in a strip shape with a first cutter;

cutting off a portion of the lid sheet along the second adjustment side in a strip shape using a second cutter; and concurrently while cutting off the portion of each of the lid sheets along the first adjustment side, forming, in the lid sheet, a second scoreline extending parallel to the first scoreline using a scoreline roller disposed at a predetermined interval from the first cutter such that the second scoreline allows the lid to be bent downwardly along a second side of the top end opening of the corresponding one of the boxes, the second side being opposed to the first side;

wherein a cut-off width of the portion of the lid sheet cut off by the first cutter, and a cut-off width of the portion of the lid sheet cut off by the second cutter are adjusted according to the size of the top end opening of the corresponding one of the boxes.

2. The dimensionally variable lid manufacturing method according to claim 1, wherein each of the lid sheets includes:

an L-shaped dimension adjustment area along the first adjustment side and the second adjustment side of the lid sheet; and a rectangular reference area surrounded by the L-shaped dimension adjustment area, the first reference side, and the second reference side of the lid sheet, and wherein an independent object is printed beforehand on the reference area.

3. The dimensionally variable lid manufacturing method according to claim 2, wherein, from a plurality of lid sheet magazines each keeping a group of the lid sheets that are different in size from the lid sheets in the other lid sheet magazines, selectively taking out, one at a time, and using the lid sheets having sizes corresponding to the sizes of the top end openings of the corresponding ones of the boxes.

4. The dimensionally variable lid manufacturing method according to claim 1, wherein, from a plurality of lid sheet magazines each keeping a group of the lid sheets that are different in size from the lid sheets in the other lid sheet magazines, selectively taking out, one at a time, and using the lid sheets having sizes corresponding to the sizes of the top end openings of the corresponding ones of the boxes.

5. A dimensionally variable lid manufacturing device for manufacturing lids which are, respectively, to be placed on a plurality of individual boxes different in size from each other such that each of the lids has a size corresponding to a size of a top end opening of a corresponding one of the individual boxes, wherein as a material for each of the lids, a rectangular lid sheet is used which is defined by a first reference side, a second reference side intersecting with the first reference side at a right angle, a first adjustment side extending parallel to the first reference side, and a second adjustment side extending parallel to the second reference side, wherein the lid sheet is formed, beforehand, with a first scoreline that allows the lid to be bent downwardly along a first side of the top end opening of the corresponding one of the boxes, and a perforated line along which the lid can be severed, the first scoreline and the perforated line extending along, and parallel to, the first reference side of the lid sheet;

the dimensionally variable lid manufacturing device comprising:

a first cutter configured to cut off, in a strip shape, a portion of the lid sheet along the first adjustment side thereof;

a second cutter configured to cut off, in a strip shape, a portion of the lid sheet along the second adjustment side thereof;

a scoreline roller disposed at a predetermined interval from the first cutter such that, when the portion of the lid sheet along the first adjustment side thereof is cut off in a strip shape by the first cutter, the scoreline roller forms, in the lid sheet, a second scoreline that extends parallel to the first scoreline of the lid sheet and allows the lid to be bent downwardly along a second side of the top end opening of the corresponding one of the boxes, the second side being opposed to the first side; and a cut-off-width adjusting mechanism configured to adjust a cut-off width of the portion of the lid sheet cut off by the first cutter, and to adjust a cut-off width of the portion of the lid sheet cut off by the second cutter, according to the size of the top end opening of the corresponding one of the boxes, wherein the dimensionally variable lid manufacturing device is configured to cut off only the strip-shape portion of the lid sheet along the first adjustment side and the strip-shape portion of the lid sheet along the second adjustment side without cutting along the first reference side or the second reference side.

6. The dimensionally variable lid manufacturing device according to claim 4, further comprising a lid sheet conveying device configured to convey the lid sheets in a direction parallel to the first reference sides of the lid sheets, wherein the first cutter is disposed at a position where the lid sheets pass so as to cut, in a conveying direction in which the lid sheets are conveyed by the lid sheet conveying device, the lid sheets while the lid sheets are being conveyed by the lid sheet conveying device, wherein the scoreline roller is disposed at a position where the lid sheets pass so as to press the lid sheets while the lid sheets are being conveyed by the lid sheet conveying device, thereby forming the second scorelines in the respective lid sheets, and wherein the dimensionally variable lid manufacturing device further comprises a second cutter moving device supporting the second cutter, and configured to move the second cutter in a direction orthogonal to the conveying direction when conveyance of each of the lid sheets is stopped, such that the second cutter cuts the lid sheet in a direction parallel to the second adjustment side and orthogonal to the first reference side of the lid sheet.

7. The dimensionally variable lid manufacturing device according to claim 6, wherein the lid sheet conveying device includes:

a lid sheet clamper configured to clamp the lid sheets from above and below the lid sheets; and a lid sheet clamper moving device configured to move the lid sheet clamper in a horizontal direction parallel to the first reference side of each of the lid sheets.

8. A dimensionally variable lid manufacturing device for manufacturing lids which are, respectively, to be placed on a plurality of individual boxes different in size from each other such that each of the lids has a size corresponding to a size of a top end opening of a corresponding one of the individual boxes, wherein as a material for each of the lids, a rectangular lid sheet is used which is defined by a first reference side, a second reference side intersecting with the first reference side at a right angle, a first adjustment side extending parallel to the first reference side, and a second adjustment side extending parallel to the second reference side, wherein the lid sheet is formed, beforehand, with a first scoreline that allows the lid to be bent downwardly along a first side of the top end opening of the corresponding one of the boxes, and a perforated line along which the lid can be severed, the first scoreline and the perforated line extending along, and parallel to, the first reference side of the lid sheet;

the dimensionally variable lid manufacturing device comprising:

a first cutter configured to cut off, in a strip shape, a portion of the lid sheet along the first adjustment side thereof;

a second cutter configured to cut off, in a strip shape, a portion of the lid sheet along the second adjustment side thereof;

a scoreline roller disposed at a predetermined interval from the first cutter such that, when the portion of the lid sheet along the first adjustment side thereof is cut off in a strip shape by the first cutter, the scoreline roller forms, in the lid sheet, a second scoreline that extends parallel to the first scoreline of the lid sheet and allows the lid to be bent downwardly along a second side of the top end opening of the corresponding one of the boxes, the second side being opposed to the first side;

a cut-off-width adjusting mechanism configured to adjust a cut-off width of the portion of the lid sheet cut off by the first cutter, and to adjust a cut-off width of the portion of the lid sheet cut off by the second cutter, according to the size of the top end opening of the corresponding one of the boxes; and a lid sheet conveying device configured to convey the lid sheets in a direction parallel to the first reference sides of the lid sheets, wherein the first cutter is disposed at a position where the lid sheets pass so as to cut, in a conveying direction in which the lid sheets are conveyed by the lid sheet conveying device, the lid sheets while the lid sheets are being conveyed by the lid sheet conveying device, wherein the scoreline roller is disposed at a position where the lid sheets pass so as to press the lid sheets while the lid sheets are being conveyed by the lid sheet conveying device, thereby forming the second scorelines in the respective lid sheets, wherein the dimensionally variable lid manufacturing device further comprises a second cutter moving device supporting the second cutter, and configured to move the second cutter in a direction orthogonal to the conveying direction when conveyance of each of the lid sheets is stopped, such that the second cutter cuts the lid sheet in a direction parallel to the second adjustment side and orthogonal to the first reference side of the lid sheet, and wherein the lid sheet conveying device includes:

a lid sheet clamper configured to clamp the lid sheets from above and below the lid sheets; and a lid sheet clamper moving device configured to move the lid sheet clamper in a horizontal direction parallel to the first reference side of each of the lid sheets.

* * * * *